United States Patent [19]

Fry

[11] 4,243,745

[45] Jan. 6, 1981

[54] ELECTROLYTIC PRODUCTION OF ACTIVE DIAZINE SPECIES

[75] Inventor: Michael W. Fry, Ilford, England

[73] Assignee: Ciba-Geigy AG, Basel, Switzerland

[21] Appl. No.: 33,365

[22] Filed: Apr. 25, 1979

[30] Foreign Application Priority Data

May 25, 1978 [GB] United Kingdom ..... 22729/78

[51] Int. Cl.[3] ..... G03C 5/30

[52] U.S. Cl. ..... 430/433; 430/440

[58] Field of Search ..... 96/66, 66 HD; 204/1 R, 204/74; 430/433, 440

[56] References Cited

U.S. PATENT DOCUMENTS 3,574,621 4/1971 Schaller et al. ..... 96/66

3,725,068 4/1973 Meier ..... 96/66 HD

*Primary Examiner*—Mary F. Downey

*Attorney, Agent, or Firm*—Sprung, Felfe, Horn, Lynch & Kramer

[57] ABSTRACT

A process for the photographic development of a light sensitive system is provided wherein photographic material having a layer comprising a photosensitive silver salt is imagewise exposed and the silver salt is imagewise developed in an acid processing solution by use of a 1,4-diazine compound reduced at most to the dihydro stage, wherein the said reduced diazine compound is produced during the development process from a 1,4-diazine or a 1,4-diazine-N-oxide by electrolytic reduction.

9 Claims, 4 Drawing Figures

ELECTROLYTIC PRODUCTION OF ACTIVE DIAZINE SPECIES

This invention relates to the photographic development of exposed photosensitive silver salt and is an improvement of or modification to the process described in British Patent Specification No. 1,183,176.

In British Patent Specification No. 1,183,176 there is described a process for developing exposed silver salts by treating the silver salts in an acid medium with a reduction product of a 1,4-diazine compound, the diazine compound having been reduced at most to the dihydro stage.

Preformed reduced diazines are used and various methods are described for preparing the reduced diazines. However it has been found tha preformed reduced diazines are extremely unstable and in British Patent Specification No. 1,331,755 there is described a process for the photographic development of silver salts to metallic silver by use of a 1,4-diazine compound reduced at most to the dihydro stage, wherein the said reduced diazine compound is produced during the developing process from a diazine compound or from an N-oxide derived therefrom by use of a reducing agent in layer form in an acid medium, the said reducing agent being a metal which in the electro-chemical series of the elements is situated above silver and up to and including aluminum.

We have now found an alternative method of preparing the reduced 1,4-diazine compound during the development process.

Therefrom according to the present invention there is provided a process for the photographic development of a light sensitive system wherein photographic material having a layer comprising a photosensitive silver salt is imagewise exposed and the silver salt is imagewise developed in an acid processing solution by use of a 1,4-diazine compound reduced at most to the dihydro stage, wherein the said reduced diazine compound is produced during the development process from a 1,4-diazine or a 1,4-diazine-N-oxide by electrolytic reduction.

Most preferably the light sensitive compound used is silver halide although other light sensitive silver salts, for example photosensitive silver oxalate, may be used. However for ease of reference the invention will hereinafter be described with reference to the development of silver halide only.

Preferably the electrical conductivity of the acid processing solutions is increased by the presence of an inert electrolyte for example sodium sulphate or ammonium nitrate.

Any 1,4-diazines may be used in the process of the present invention, but especially the diazines set forth in British Patent Specifications Nos. 1,183,176; 1,330,755.

Particularly well suited for the present process are quinoxalines, pyrazines and phenazines which are unsubstituted or substituted by 1 or 2 lower alkyl groups, one lower alkyl group and a carboxyl group or acetyl group, a carboxyl group, an acetyl group or a d-arabotetra-hydroxybutyl group, e.g. pyrazine, 2,3-dimethyl quinoxaline, 2-methyl-3-acetylquinoxaline, quinoxaline, pyrazine-2-carboxylic acid, phenazine or 2-(d-arabotetrahydroxybutyl)-quinoxaline. By lower alkyl group is meant an alkyl group having from 1 to 3 carbon atoms.

However the preferred diazine is pyrazine.

Preferably the process is effected in aqueous medium, adjusted by a suitable acid or a buffer mixture to acid reaction, preferably to a pH value between 0 and 4. The rate of development and the gradation of the developed image may be altered within wide limits as function of the pH value. The following acids and buffer substances are exemplary:

Aliphatic, aromatic or heterocyclic mono- , di- and tricarboxylic acids which may also contain substituents such as chlorine, bromine and iodine atoms, hydroxyl-, nitro-, amino- or acylamino groups; aliphatic or aromatic sulphonic acids, phosphoric acids, and $HSO_4^{\oplus}$, HF, HCl, HBr, $HClO_4$, $HNO_3$, $H_2SO_4$, $H_3PO_4$, $H_2CO_3$, $HSO_3^{\oplus}$, $A1(H_2O)_6^{3\ominus}$, $HBF_4$.

There may be present in the aqueous development solution silver halide solvents such as bromide ions, thiocyanate ions or thiourea in suitable concentration. Anti-foggants such as benzotriazole or phenyl mercaptotetrazole may also be added. Hardening agents for gelatin, toning substances for the generation of a blue-black silver image and surface-active substances may also be added to the solution.

The process of the present invention is suitable for the development of any silver halide emulsion, e.g. those from silver chloride, silver bromide, silver chlorobromide or silver iodobromide, the emulsions in the customary layer formers, preferably gelatin, also containing the customary additives such as sensitisers and surface-active substances and being sensitive to the most varied rays of corpuscular or electromagnetic nature. Silver salts free of binders which have been vapour-deposited onto a support can also be developed in accordance with the invention.

The term "development" is to be understood here to mean generally the liberation of silver from silver salts contained in layer materials, that is to say not only the selective reduction of imagewise exposed silver halide crystals, but also the reduction of silver salts which can be developed without exposure, such as, e.g. re-halogenised silver or silver salts with fog nuclei, as are present for example in chemically aged emulsions and pre-fogged emulsions. Likewise the secondary development in a reversal process.

Of particular importance are those embodiments of the process in accordance with the invention wherein the developed silver image, the undeveloped silver salt image which is oppositely oriented to the developed silver image, or the corresponding distribution of unused developed substance in the silver salt image, or the used developer substance, which is distributed imagewise, are used for the promotion of further chemical reactions, whereby pictures are formed which are based on dye formation, dye decomposition, differences in the degree of polymerisation of the layer colloid, variable diffusibility (e.g. silver complex diffusion process) or sublimability. Of particular importance is the production of multicolour and monochromatic photographic images.

The process of the present invention is of particular use in a process for the production of a photographic image which comprises the steps of (a) imagewise exposing a silver halide emulsion layer in a photographic assembly which comprises at least during the silver halide developing step, a silver halide emulsion layer, a layer containing a substantive bleachable image dye, optionally one or more interlayers and a photobase and (b) treating the exposed photographic material with a solution or dispersion of a bleach-developer compound thereby to develop the latent silver halide image in the silver halide emulsion layer and in the non-latent image areas causing the bleach-developer compound to diffuse in a counter-imagewise manner from the silver halide emulsion layer to the bleachable image dye layer and there to bleach the image dye to form a photographic image.

By bleach-developer compound is meant a compound which is able both to develope a latent silver image and to bleach a bleachable dye. Examples of suitable bleach-developers are reduced silver-dye bleach catalysts and in particular reduced 1,4-diazine compounds. Thus in this process when the bleach-developer compound used is a reduced 1,4-diazine it may be produced during the silver halide development step (b) by electrolysis.

Various photographic assemblies can be used with this process and such assemblies are described in the Examples which follow.

The process of the present invention is also of particular use in a process for the production of a photographic image which comprises (a) imagewise exposing a photographic assembly which comprises, at least during the processing steps, a silver halide emulsion layer and present in the silver halide emulsion layer or in a separate layer in operative contact therewith a dye-releasing compound and a dye-receiving layer, (b) treating the exposed photographic assembly with a solution or dispersion of a redev compound as hereinafter defined thereby to develope the latent silver image in the silver halide emulsion layer but in the non-latent image areas reducing the dye-releasing compound and liberating the diffusible dye if the dye-releasing compound is present in the silver halide emulsion layer or if it is not present in the silver halide emulsion layer to diffuse imagewise to the layer which comprises the dye-releasing compound and there to reduce the dye-releasing compound and to liberate the diffusible dye, (c) causing the liberated diffusible dye to diffuse imagewise to the receiving layer, and (d) fixing the diffused dye in the receiving layer thereby to form a dye image.

By 'redev compound' is meant a compound which is able to develope a latent silver image and also to reduce the dye-releasing compound and liberate the diffusible dye. Examples of suitable redev compounds are reduced silver-dye bleach catalysts and in particular reduced 1,4-diazine compounds. Thus in this process when the redev compound used is a reduced 1,4-diazine it may be produced during the silver halide development step (b) by electrolysis. An example of such a process is given in Example 2 which follows.

According to a preferred aspect of the present invention there is provided a process for the photographic development of a light-sensitive system wherein photographic material having a layer comprising a photosensitive compound is imagewise exposed and the light-sensitive compound is imagewise developed in acid conditions by a reduced 1,4-diazine compound, which comprises applying to the photosensitive layer side of the photographic material a thin layer of an acid solution of a 1,4-diazine compound which thin layer is in electrical contact with a bulk solution of the 1,4-diazine compound in which is present an anode connected to D.C. (direct current) power supply and then passing the photosensitive side of the photographic material carrying the layer of 1,4-diazine solution thereon into contact with a cathode which extends across the width of the photographic material and which is electrically connected to the said anode to form an electrolytic cell, thereby forming reduced 1,4-diazine compound in the photographic material as it comes into contact with the said cathode and the reduced 1,4-diazine compound developing the imagewise exposed light-sensitive compound.

Preferably in this process the photosensitive compound is silver halide.

Preferably in this process the viscosity of the acid processing solution is increased by the addition of a solution viscosity increasing agent for example hydroxy ethyl cellulose or xanthan gum.

The accompanying drawings will serve to illustrate the apparatus which can be used to carry out the process of the present invention.

Figure 1:
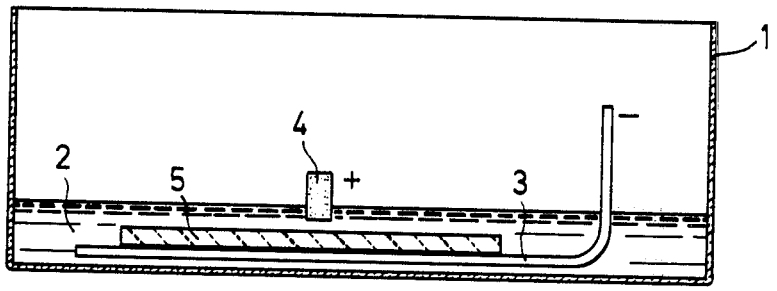
FIG. 1 is a cross-sectional view of a processing tank of use with the process of the present invention.

In FIG. 1 a glass processing tank 1 contains a solution 2 of pyrazine in dilute sulphuric acid pH about 0.8. Located in tank 1 is a shaped stainless steel cathode 3 and a carbon anode 4. Shown resting on the stainless steel cathode is a film assembly 5 which can be the film assembly of FIG. 4.

Figure 2:
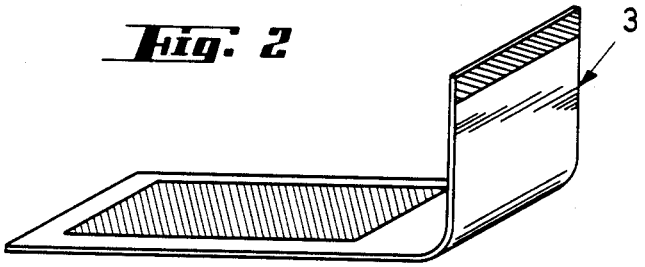
FIG. 2 is a perspective view of the cathode used in the tank of FIG. 1.

It has been found preferable to cover the stainless steel cathode with a non-conducting plastic material except for an area the same shape and size as the photographic assembly being processed. This is shown in FIG. 2 where the hatched line area is the exposed stainless steel whilst the clear area is a thin plastic material non-conducting mask. The plastic material prevents reduction of pyrazine in the masked area. This eliminates reduction of pyrazine other than in contact with the photographic assembly.

Figure 3:
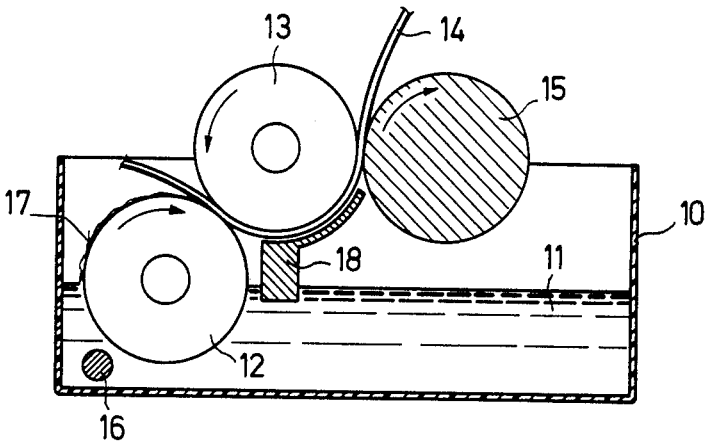
FIG. 3 is a cross-sectional view of a processing apparatus which can be used to carry out the process of the present invention.

In FIG. 3 a plastic material processing tank 10 contains a solution 11 of pyrazine in dilute sulphuric acid, pH about 0.8. Located in the tank are two rubber-covered rollers 12 and 13. The rollers rotate in the direction indicated thereon. Lightly touching roller 13 is a stainless steel roller 15 which is the cathode. Also present in the tank 10 is an anode 16.

Figure 4:
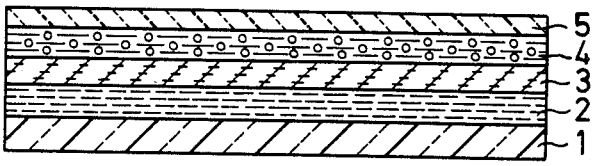
FIG. 4 is a cross-section through a film assembly which can be used in the process of the present invention.

Shown present in the nips between rollers 12 and 13 and between rollers 12 and 15 is a photographic assembly 14 such as the photographic assembly of FIG. 4. A guide 18 guides the assembly 14 to the roller 15.

A layer 17 of solution 11 is shown covering part of the periphery of roller 12. This solution is transferred to the underside of the film assembly as presented to the processing apparatus. In practice the supercoat and photosensitive layers are on the underside of the assembly as presented to the processing apparatus. Thus a layer 17 of processing solution 11 is coated on the supercoat layer of the film assembly by roller 12. This layer comes into contact with the cathode roller 15.

FIG. 4 is a cross-sectional view of a film assembly. The assembly comprises a transparent photobase 1 having coated thereon in order a bleachable image dye layer 2, a titanium oxide layer 3, a negative-working silver bromide gelatin layer 4 and a gelatin supercoat layer 5.

The following examples will serve to illustrate the invention:

EXAMPLE 1

A photosensitive material was prepared by coating sequentially on to a 0.1 mm thick clear colourless photobase the following layers:

1. A silver iodobromide emulsion (1.6% iodide, 5 g $m^{-2}$ silver) in gelatin (3.3 g $m^{-2}$).
2. A protecting layer containing gelatin 1.0 g $m^{-2}$.

This photosensitive material was exposed to light behind a grey wedge and then processed by passing through the machine as in FIG. 3 at 20° C. in the dark. The time taken to pass 1 cm of film through the machine was 16 sec with an applied voltage of 14 v and current between 0.01 and 0.03 A. The processing liquid was as follows:

Pyrazine: 1.0 g
Ammonium nitrate: 32.0 g
Natrosol 250 HH: 0.5 g (hydroxy ethyl cellulose)
Sulphuric acid (5 N): 16.0 ml
Distilled water up to: 200 ml After processing a negative silver image could be seen on the emulsion side.

EXAMPLE 2

A photosensitive assembly was prepared as shown in FIG. 4.

The photobase 1 was a 0.1 mm thick layer of clear cellulose triacetate photobase.

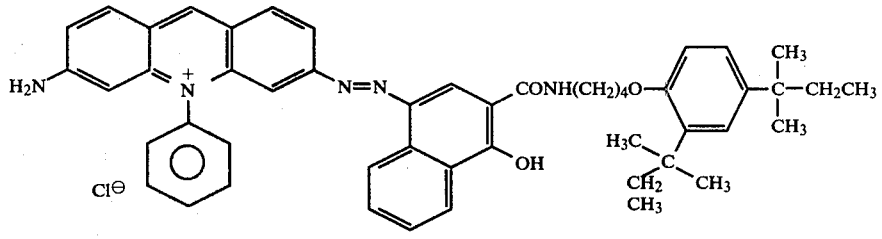

The dye layer 2 contains the magenta dyestuff:

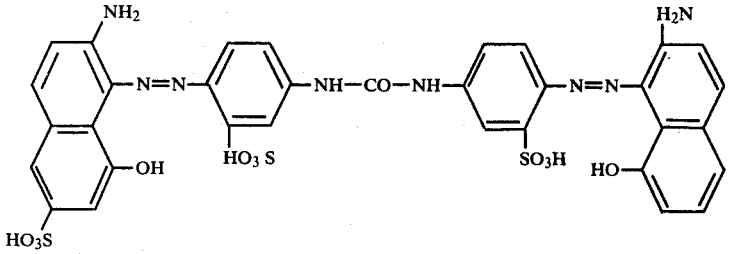

The coating weight of the dye being 0.15 g $m^{-2}$, in a gelatin binder having a coating weight of 3.0 g $m^{-2}$. The reflecting layer 3 comprised titanium dioxide the coating weight of which was 23 g $m^{-2}$, in a gelatin binder having a coating weight of 3.0 g $m^{-2}$.

The silver halide emulsion layer 4 was a silver bromide emulsion having a coating weight of 15 g $m^{-2}$, in a gelatin binder having a coating weight of 2.0 g $m^{-2}$.

The gelatin supercoat layer had a coating weight of 1.0 g $m^{-2}$.

This photosensitive assembly was light exposed behind a grey wedge and then processed by passing it through a processing apparatus as shown in FIG. 3 at 20° C. in the dark.

The time taken to pass 1 cm of film through the machine was 16 sec with an applied voltage of 14 v and current between 0.01–0.03 A. The processing liquid consisted of:

2,3 dimethyl quinoxaline: 1.0 g
Ammonium nitrate: 32 g
Sulphuric acid (5N): 20 ml
Distilled water to make: 200 ml.

After processing, a negative magenta image could be seen by viewing through the base while a negative silver image could be seen on the emulsion side.

EXAMPLE 3

A photosensitive material was prepared by coating sequentially on to a 0.1 mm thick transparent colourless photobase the following layers:

1. A mordant layer containing an anionically charged polymer chemical from an aqueous latex of a polymer.

The latex used contained 50 parts of styrene, 50 parts of butyl acrylate and the surfactant was an alkyl aryl poly (oxyethylene) sulphate. This latex was coated to yield a polymer having a coating weight of 18 g $m^{-2}$ together with gelatin 6 g $m^{-2}$.
2. A reflecting layer containing titaniun dioxide (23 g $m^{-2}$) and gelatin (3.0 g $m^{-2}$).
3. A dye releasing layer containing the dye releasing compound (0.1 g $m^{-2}$) and gelatin (3.0 g $m^{-2}$)
4. A silver bromide emulsion containing 15 g $m^{-2}$ silver and gelatin (2.0 g $m^{-2}$).
5. A protecting layer containing gelatin (1.0 g $m^{-2}$).

The above photosensitive material was exposed to light behind a grey wedge and then processed by passing through the machine as in FIG. 3 in the dark at 20° C. The time taken to pass through the machine was 16 sec per cm of film. The applied voltage was 14 v and the current was between 0.01 and 0.03 A. The processing liquid in the machine consisted of:

Pyrazine: 1.0 g
Ammonium nitrate: 32.0 g
Sulphuric acid (5 N): 20.0 ml
Distilled water to make: 200 ml After processing, a positive magenta image of the wedge could be seen in the mordant layer by viewing through the base while a negative silver image could be seen on the emulsion side.

EXAMPLE 4

A photosensitive material was constructed by coating sequentially on to polyethylene-laminated paper base:

1. Silver chlorobromide emulsion (70% chloride, 30% bromide: 1.35 $g/m^{-2}$ silver, 5.0 $gm^{-2}$ gelatin).
2. A gelatin supercoat (1.3 $gm^{-2}$) with glyoxal hardener.

The assembly was exposed to light behind a grey wedge and then processed by passing it through an apparatus as shown in FIG. 3 at 20° C. in the dark. The time taken to pass 1 cm of the material through the machine was 30 seconds with an applied voltage of 14 v. and a current of approximate 0.01 A.

The processing liquid consisted of

Pyrazine: 2 g
Orthophosphoric acid (5 M): 40 ml
Distilled water: 150 ml

After fixing the material in an ammonium thiosulphate solution a negative silver image was obtained.

EXAMPLE 5

A material similar to that of Example 4 was likewise exposed and processed by passing it through the same processing machine as in Example 4 under similar conditions. The processing liquid in this case consisted of Pyrazine: 1 g
5 N sulphuric acid: 20 ml
Xanthan gum (Kelzan-Trademark): 1 g
Distilled water to make: 200 ml After fixing as in Example 4 a negative silver image was obtained.

EXAMPLE 6

A photosensitive material was constructed by coating sequentially on to 0.1 mm clear colourless cellulose triacetate photobase:

1. Silver bromide emulsion panchromatically sensitized (cubic monosize, crystal edge length 0.26 $\mu m$; median) to give a silver coating weight of 1.6 $gm^{-2}$.
2. A gelatin supercoat (1.25 $gm^{-2}$ gelatin) with glyoxal hardener.

This assembly was exposed to light behind a grey wedge. It was then processed by passing it through an apparatus under similar conditions to those in Example 4. The processing solution in this case was:

Pyrazine: 1 g
5 N sulphuric acid: 20 ml
Xanthan gum (Kelzan-Trademark: 1 g
Ammonium nitrate: 20 g
Distilled water to make: 200 ml After fixing as in Example 4 a negative silver image was obtained.

What is claimed is:

1. A process for developing an imagewise exposed photographic material containing in a layer a photosensitive silver halide or silver oxalate which comprises developing said imagewise exposed silver salts in an acid processing solution containing a 1,4-diazine compound reduced at most to the dihydro stage, wherein the said reduced diazine compound is produced during the development process from a 1,4-diazine or a 1,4-diazine-N-oxide by electrolytic reduction.

2. A process according to claim 1 wherein the silver salt is a silver halide.

3. A process according to claim 1 wherein the electrical conductivity of the acid processing solution is increased by the presence of an inert electrolyte.

4. A process according to claim 1 wherein the 1,4-diazine is a quinoxaline, pyrazine or phenazine, each of which may be unsubstituted or substituted by 1 or 2 lower alkyl groups, one lower alkyl group and a carboxyl group or acetyl group, a carboxyl group, an acetyl group or a d-arabotetrahydroxybutyl group.

5. A process according to claim 1 wherein the 1,4-diazine is pyrazine.

6. A process according to claim 1 wherein the acid processing solution is an aqueous acid processing solution adjusted by acid or buffer mixture to a pH value between 0 and 4.

7. A process for developing an imagewise exposed photographic material containing in a layer a photosensitive silver halide or silver oxalate which comprises developing said imagewise exposed silver salts in an acid processing solution containing a 1,4-diazine compound which comprises applying to the photosensitive layer side of the photographic material a thin layer of an acid solution of a 1,4-diazine compound which thin layer is in electrical contact with a bulk solution of the 1,4-diazine compound in which is present an anode connected to D.C. power supply and then passing the photosensitive side of the photographic material carrying the layer of 1,4-diazine solution thereon into contact with a cathode which extends across the width of the photographic material and which is electrically connected to the said anode to form an electrolytic cell, thereby forming reduced 1,4-diazine compound in the photographic material as it comes into contact with the said cathode and the reduced 1,4-diazine compound developing the imagewise exposed light-sensitive compound.

8. A process according to claim 7 wherein the photosensitive silver compound is a silver halide.

9. A process according to claim 7 wherein the acid processing solution contains a viscosity increasing agent.

* * * * *

UNITED STATES PATENT AND TRADEMARK OFFICE

CERTIFICATE OF CORRECTION

PATENT NO. : 4,243,745

DATED : January 6, 1981

INVENTOR(S) : Michael William Fry

It is certified that error appears in the above—identified patent and that said Letters Patent is hereby corrected as shown below:

Column 1, line 17, delete "tha" and insert --that--.
Column 2, line 14, delete "$Al(H_2O)_6 3\ominus$ and insert --$Al(H_2O)_6\ 3\oplus$ --.

Column 3, line 9, delete "develope" and insert --develop--.
Column 3, line 43, delete "develope" and insert --develop--.

Column 6, line 27, delete "titaniun" and insert --titanium--.

Signed and Sealed this

*Twelfth* Day of *May 1981*

[SEAL]

*Attest:*

RENE D. TEGTMEYER

*Attesting Officer*

*Acting Commissioner of Patents and Trademarks*